US009715857B2

(12) United States Patent
Liu

(10) Patent No.: US 9,715,857 B2
(45) Date of Patent: Jul. 25, 2017

(54) SIGNAL CONVERSION DEVICE AND METHOD, SIGNAL GENERATING SYSTEM AND DISPLAY APPARATUS

(71) Applicant: BOE TECHNOLOGY GROUP CO., LTD., Beijing (CN)

(72) Inventor: Jianfu Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 28 days.

(21) Appl. No.: 14/905,413

(22) PCT Filed: Aug. 17, 2015

(86) PCT No.: PCT/CN2015/087232

§ 371 (c)(1),
(2) Date: Jan. 15, 2016

(87) PCT Pub. No.: WO2016/123956

PCT Pub. Date: Aug. 11, 2016

(65) Prior Publication Data

US 2016/0372059 A1 Dec. 22, 2016

(30) Foreign Application Priority Data

Feb. 5, 2015 (CN) ..... 2015 1 0061190

(51) Int. Cl.
*G09G 3/36* (2006.01)
*G09G 3/20* (2006.01)
*G09G 5/00* (2006.01)

(52) U.S. Cl.
CPC ..... *G09G 3/3607* (2013.01); *G09G 3/2003* (2013.01); *G09G 3/3696* (2013.01);
(Continued)

(58) Field of Classification Search
CPC .. G09G 3/3607; G09G 3/2003; G09G 3/3696; G09G 5/006; G09G 2320/0666;
(Continued)

(56) References Cited

U.S. PATENT DOCUMENTS 6,037,925 A * 3/2000 Kim ..... G09G 3/3611 345/213
6,177,922 B1 * 1/2001 Schiefer ..... G09G 5/005 345/213

(Continued)

FOREIGN PATENT DOCUMENTS

CN 1388512 A 1/2003
CN 202584678 U 12/2012

(Continued)

OTHER PUBLICATIONS

International Search Report dated Oct. 22, 2015 issued in corresponding International Application No. PCT/CN2015/087232 along with an English translation of the Written Opinion of the International Searching Authority.

*Primary Examiner* — Tom Sheng
(74) *Attorney, Agent, or Firm* — Nath, Goldberg & Meyer; Joshua B. Goldberg

(57) ABSTRACT

The present invention discloses a signal conversion device, a signal conversion method, a signal generating system and a display apparatus. The signal conversion device comprises: a pixel signal transmitting chip transmitting a plurality of pixel signals arranged in a first arrangement order; a patch unit rearranging the plurality of pixel signals in second arrangement order; a signal conversion chip converting the plurality of pixel signals arranged in the first or second arrangement order into a display signal packet in a first or second predetermined format; and a signal generating and outputting unit converting the display signal packet in
(Continued)

the second predetermined format into display signal packet in a third predetermined format.

18 Claims, 4 Drawing Sheets

(52) U.S. Cl.
CPC ..... *G09G 5/006* (2013.01); *G09G 2320/0666* (2013.01); *G09G 2370/00* (2013.01); *G09G 2370/08* (2013.01); *G09G 2370/10* (2013.01); *G09G 2370/14* (2013.01)

(58) Field of Classification Search
CPC ..... G09G 2370/00; G09G 2370/08; G09G 2370/10; G09G 2370/14; G09G 2340/0435; G09G 2360/02; H04N 13/0029
See application file for complete search history.

(56) References Cited

U.S. PATENT DOCUMENTS 6,392,656 B1 * 5/2002 Someya ..... G09G 3/3413 345/589
7,339,570 B2 * 3/2008 Kubota ..... G09G 3/2011 345/100
7,486,283 B1 * 2/2009 Lin ..... G06F 3/14 345/100
7,791,609 B2 * 9/2010 Lee ..... G09G 5/006 345/531
7,830,332 B2 * 11/2010 Park ..... G09G 5/006 345/1.1
2002/0089518 A1 * 7/2002 Shigeta ..... G06F 3/14 345/629
2009/0070501 A1 * 3/2009 Kobayashi ..... G06T 1/00 710/65
2009/0303331 A1 * 12/2009 Yoon ..... G09G 3/006 348/189
2014/0307163 A1 * 10/2014 Wu ..... H04N 7/01 348/441
2016/0035313 A1 * 2/2016 Zhang ..... H04N 5/268 348/474

FOREIGN PATENT DOCUMENTS

CN 104599654 A 5/2015
JP H10-254417 A 9/1998
JP 2000-338921 A 12/2000
WO 2013/024792 A1 2/2013

* cited by examiner

SIGNAL CONVERSION DEVICE AND METHOD, SIGNAL GENERATING SYSTEM AND DISPLAY APPARATUS

This is a National Phase Application filed under 35 U.S.C. 371 as a national stage of PCT/CN2015/087232, filed Aug. 17, 2015, an application claiming the benefit of Chinese Application No. 201510061190.2, filed Feb. 5, 2015, the content of each of which is hereby incorporated by reference in its entirety.

FIELD OF THE INVENTION

The present invention relates to the field of display technology, and particularly to a signal conversion device, a signal conversion method using the signal conversion device to convert signals, a signal generating system comprising the signal conversion device and a display apparatus comprising the signal generating system.

BACKGROUND OF THE INVENTION

When driving a liquid crystal display panel, it is required to use a signal generating system to convert a video or image into LVDS signals for driving the liquid crystal display panel. Generally, the signal generating system comprises a graphic processing main chip, a RGB pixel signal transmitting chip and a signal conversion chip. The graphic processing main chip is configured for converting a video or image into RGB signals, the RGB pixel signal transmitting chip is configured for transmitting the received RGB pixel signals to the signal conversion chip, and the signal conversion chip is capable of converting the received RGB pixel signals into LVDS signals for driving the liquid crystal display panel.

At present, a liquid crystal display panel with a size smaller than 42 inch may be driven by using 8-bit LVDS signals. With the user's demand on a large-sized display device, a liquid crystal display panel with a size more than 42 inch has occurred. Since the increase of size of the liquid crystal display panel, 10-bit LVDS signals are required to drive the liquid crystal display panel with a size more than 42 inch. Therefore, an apparatus for producing the signal generating system for generating 8-bit LVDS signals cannot be used any longer, wasting resources.

Hence, how to continue to use the existing signal generating system to drive a liquid crystal display panel with a larger size has become a technical problem to be solved urgently.

SUMMARY OF THE INVENTION

An object of the present invention is to provide a signal conversion device and method, a signal generating system and a display apparatus, which may not only drive a liquid crystal display panel with a size smaller than 42 inch, but also drive a liquid crystal display panel with large size.

To realize the above object, as an aspect of the present invention, provided is a signal conversion device, comprising a pixel signal transmitting chip configured for receiving and transmitting a plurality of pixel signals of n colors, which are arranged in a first arrangement order; and a signal conversion chip capable of converting the plurality of pixel signals arranged in the first arrangement order into a display signal packet in a first predetermined format and outputting the display signal packet to drive a display device with a predetermined size, wherein the signal conversion device further comprises:

a patch unit, which has input terminals connected to output terminals of the pixel signal transmitting chip, and is configured for rearranging the plurality of pixel signals in the first arrangement order into pixel signals in a second arrangement order and outputting the rearranged pixel signals;

a signal conversion chip capable of converting the plurality of pixel signals arranged in the second arrangement order into a display signal packet in a second predetermined format; and a signal generating and outputting unit configured for generating a display signal packet in a third predetermined format from the display signal packet in the second predetermined format output from the signal conversion chip, and dividing the generated display signal packet into groups and outputting the same so as to drive a display device with a size larger than the predetermined size, wherein in the display signal packet in the first predetermined format and the display signal packet in the second predetermined format, display data corresponding to pixel signals of each color includes M bits, M is an even number, and in the display signal packet in the second predetermined format, a total n*M bits of display data are divided into M/2 groups and the signal conversion chip outputs the M/2 groups of display data;

in the display signal packet in the third predetermined format, display data corresponding to pixel signals of each color includes N bits, N is an even number and larger than M, and in the display signal packet in the third predetermined format, a total n*N bits of display data are divided into N/2 groups, the lowest (N−M) bits of display data of each color are in the last (N−M)/2 groups, and are noise small analog signals;

the M/2 groups of display data in the display signal packet in the second predetermined format correspond to the first M/2 groups of display data in the display signal packet in the third predetermined format one to one, and any display data in the display signal packet in the second predetermined format is lower than a corresponding display data in the display signal packet in the third predetermined format by (N−M) bits.

Preferably, the pixel signal transmitting chip has n*M output terminals, each of which is configured for outputting a pixel signal;

the patch unit has n*M input terminals and n*M output terminals, the n*M input terminals of the patch unit are connected to the n*M output terminals of the pixel signal transmitting chip in one-to-one correspondence, the n*M input terminals and the n*M output terminals of the patch unit are connected in one-to-one correspondence through connection channels according to a predetermined rule, so that the pixel signals input in the first arrangement order are output in the second arrangement order;

the signal conversion chip has n*M input terminals, the n*M input terminals of the signal conversion chip are connected to the n*M output terminals of the patch unit in one-to-one correspondence.

Preferably, the patch unit comprises a patch plate including two sets of pads, each set of pads include n*M pads, one set of pads function as input terminals of the patch plate, and the other set of pads function as output terminals of the patch plate, and the one set of pads are communicated with the other set of pads in one-to-one correspondence according to the predetermined rule.

Preferably, the patch unit further comprises a resistor network detachably connected with the patch plate, the resistor network includes n*M resistors which are connected between the n*M output terminals of the pixel signal transmitting chip and the n*M input terminals of the signal conversion chip in one-to-one correspondence, resistances of wires on the patch plate connected between the input terminals and corresponding output terminals of the patch plate are smaller than those of the resistors, and when the patch plate is detached, the pixel signal transmitting chip is capable of outputting the pixel signals in the first arrangement order to the signal conversion chip through the resistor network.

Preferably, the display signal packet is a low voltage differential signal packet.

Preferably, n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

As another aspect of the present invention, provided is a signal generating system comprising a image processing main chip and a signal conversion device, the image processing main chip is configured for converting a video or image into pixel signals and transmitting the pixel signals to a pixel signal transmitting chip of the signal conversion device, wherein the signal conversion device is the signal conversion device provided above.

As still another aspect of the present invention, provided is a display apparatus comprising a display panel and a signal generating system, wherein the signal generating system is the above signal generating system provided by the invention, the display panel comprises a display signal input interface including N/2 channels, the M/2 output terminals of the signal conversion chip are respectively connected to the first M/2 channels of the display signal input interface in one-to-one correspondence.

Preferably, the display apparatus further comprises a storage unit configured for prestoring a video or image, and output terminals of the storage unit are connected to the input terminals of the image processing main chip.

As still another aspect of the present invention, provided is a signal conversion method comprising a step of converting a plurality of pixel signals arranged in a first arrangement order into a display signal packet in a first predetermined format to drive a display device with a predetermined size, wherein the signal conversion method further comprises steps of:

rearranging the plurality of pixel signals of n colors in the first arrangement order into pixel signals in a second arrangement order;

converting the plurality of pixel signals arranged in the second arrangement order into a display signal packet in a second predetermined format;

generating a display signal packet in a third predetermined format from the display signal packet in the second predetermined format, and dividing the generated display signal packet into groups and outputting the same so as to drive a display device with a size larger than the predetermined size, wherein in the display signal packet in the first predetermined format and the display signal packet in the second predetermined format, display data corresponding to pixel signals of each color includes M bits, M is an even number, and in the display signal packet in the second predetermined format, a total n*M bits of display data are divided into M/2 groups and the signal conversion chip outputs the M/2 groups of display data;

in the display signal packet in the third predetermined format, display data corresponding to pixel signals of each color includes N bits, N is an even number and larger than M, and in the display signal packet in the third predetermined format, a total n*N bits of display data are divided into N/2 groups, the lowest (N−M) bits of display data of each color are in the last (N−M)/2 groups, and are noise small analog signals;

the M/2 groups of display data in the display signal packet in the second predetermined format correspond to the first M/2 groups of display data in the display signal packet in the third predetermined format one to one, and any display data in the display signal packet in the second predetermined format is lower than a corresponding display data in the display signal packet in the third predetermined format by (N−M) bits.

Preferably, the display signal packet is a low voltage differential signal packet.

Preferably, n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

In the present invention, the display signal packet in the third predetermined format (that is, JEIDA format) may drive a display panel with a predetermined size.

In the case that pixel signals output from the pixel signal transmitting chip are directly converted by the signal conversion chip, a display signal packet in the first predetermined format, including n*M bits of display data, will be obtained. The display signal packet in the first predetermined format may be used to drive a display panel with a size smaller than the above predetermined size.

It can be seen from above that, the signal conversion device provided in the present invention is obtained by improving the existing signal conversion device. In other words, an existing signal generating system may be used to drive a display panel with a larger size.

BRIEF DESCRIPTION OF THE DRAWINGS

Accompanying drawings are used to provide further understanding of the present invention, constitute a part of the specification, and are used to explain the present invention together with following embodiments, but not to limit the present invention, wherein.

REFERENCE NUMERALS

100: pixel signal transmitting chip;

200: patch unit;

300: signal conversion chip;
400: image processing chip
500: storage unit
600: display panel
700: signal generating and outputting unit

DETAILED DESCRIPTION OF EMBODIMENTS

Embodiments will be described in detail below in conjunction with the accompanying drawings. It should be understood that, the embodiments described herein are only used to describe and explain the present invention, but not to limit the present invention.

Figure 2:
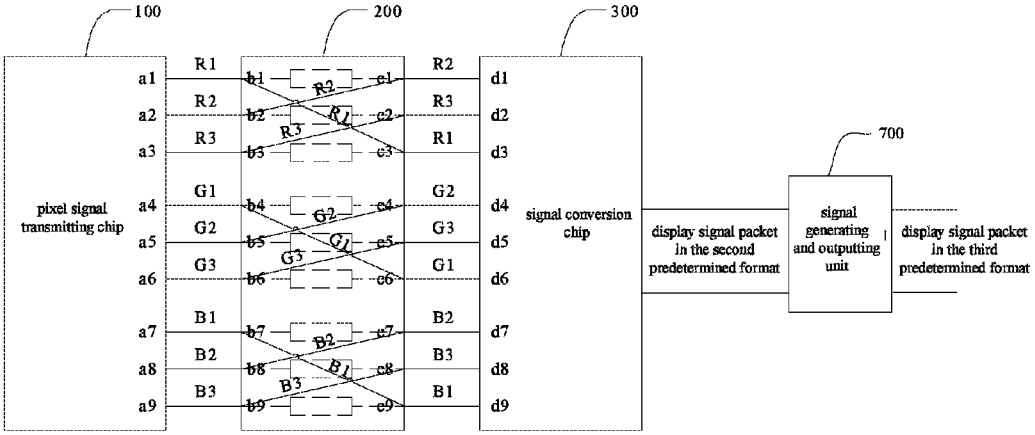
FIG. 2 is a diagram of a signal conversion device provided in the present invention.

As shown in FIG. 2, as an aspect of the present invention, provided is a signal conversion device, comprising:

a pixel signal transmitting chip 100, which is configured for receiving and transmitting a plurality of pixel signals of n colors, which are arranged in a first arrangement order; and a signal conversion chip 300, which is capable of converting the plurality of pixel signals arranged in the first arrangement order into a display signal packet in a first predetermined format so as to drive a display device with a size not larger than a predetermined size (for example, 42 inch) by using the display signal packet in the first predetermined format.

Furthermore, the signal conversion device further comprises:

a patch unit 200, input terminals of which are connected to the output terminals of the pixel signal transmitting chip 100, and which is configured for rearranging the plurality of pixel signals in the first arrangement order into pixel signals in a second arrangement order and outputting the rearranged pixel signals; and a signal generating and outputting unit 700, which is configured for generating a display signal packet in a third predetermined format from the display signal packet in the second predetermined format output from the signal conversion chip 300, and dividing the generated display signal packet into groups and outputting them so as to drive a display device with a size larger than the predetermined size.

In the present embodiment, the signal conversion chip 300 is capable of converting the plurality of pixel signals arranged in the second arrangement order into a display signal packet in a second predetermined format.

In the display signal packet in the first predetermined format and the display signal packet in the second predetermined format, display data corresponding to pixel signals of each color includes M bits, M is an even number, and in the display signal packet in the second predetermined format, a total n*M bits of display data are divided into M/2 groups and the signal conversion chip 300 includes M/2 output terminals for outputting the display data of M/2 groups, respectively.

The display signal packet in the third predetermined format is used to drive a liquid crystal display panel with a size larger than the predetermined size, and in the display signal packet in the third predetermined format, display data corresponding to pixel signals of each color includes N bits, N is an even number and larger than M, and in the display signal packet in the third predetermined format, a total n*N bits of display data are divided into N/2 groups, the lowest (N−M) bits of display data of each color are in the last (N−M) 2 groups, and are noise small analog signals;

M/2 groups of display data in the display signal packet in the second predetermined format correspond to the first M/2 groups of display data in the display signal packet in the third predetermined format one to one, and any display data in the display signal packet in the second predetermined format is lower than a corresponding display data in the display signal packet in the third predetermined format by (N−M) bits.

It should be pointed out that, the plurality of pixel signals may include pixel signals of three colors, and may also include pixel signals of four or more than four colors. When n is 3, the pixel signals are RGB pixel signals, and when n is 4, the pixel signals are RGBX pixel signals, wherein X may be white, yellow or other color.

As mentioned above, since in the display signal packet in the third predetermined format, the lowest (N−M) bits of display data of each color are noise small analog signals, a display panel with a size larger than the predetermined size may be driven even without the above lowest (N−M) bits of display data of each color.

As mentioned above, the display data of M/2 groups in the display signal packet in the second predetermined format correspond to the display data of the first M/2 groups in the display signal packet in the third predetermined format one to one, and any display data in the display signal packet in the second predetermined format is lower than a corresponding display data in the display signal packet in the third predetermined format by (N−M) bits. It can be seen from above that, display data corresponding to respective colors in the display signal packet in the second predetermined format is arranged in the same order as that in the display signal packet in the third predetermined format.

Figure 1:
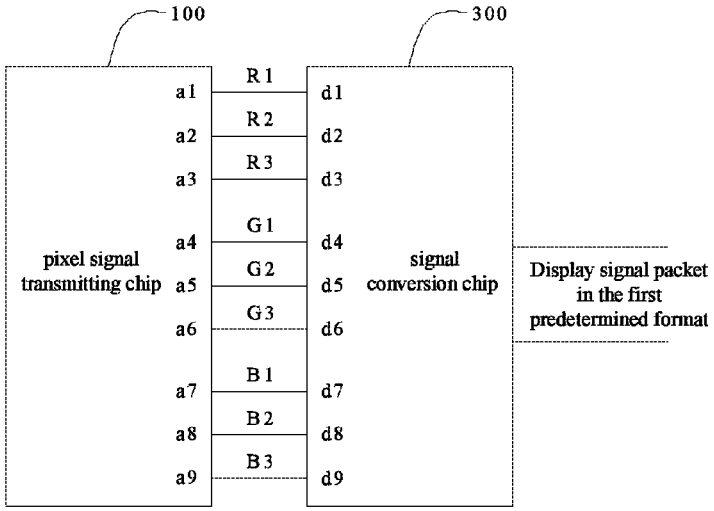
FIG. 1 is a diagram of a signal conversion device in the prior art.

As mentioned above, in the case that pixel signals transmitted from the pixel signal transmitting chip 100 is directly converted by the signal conversion chip 300, a display signal packet in the first predetermined format, including display data of n*M bits, will be obtained. As shown in FIG. 1, the pixel signals are RGB pixel signals. Accordingly, the display signal packet in the first predetermined format includes display data of 3M bits. It should be pointed out that, the display signal packet in the first predetermined format may be used to drive a display panel with a size the same as or smaller than the above predetermined size.

It can be seen from above that, the signal conversion device provided in the present invention is obtained by improving the existing signal conversion device. In other words, an existing signal generating system may be used to drive a display panel with a larger size.

In the present invention, there is no limitation to specification of the patch unit 200. That is to say, a person skilled in the art may convert the plurality of pixel signals arranged in the first arrangement order into the plurality of pixel signals arranged in the second arrangement order by any available method. A person skilled in the art should understand that, while arrangement order of the plurality of pixel signals is changed, content of the plurality of pixel signals is not changed.

In a preferable embodiment of the present invention, the pixel signal transmitting chip 100 has n*M output terminals, each of which is configured for outputting a pixel signal. Pixel signals of various colors are output from the n*M output terminals. When the pixel signals are RGB pixel signals, the pixel signal transmitting chip 100 has 3M output terminals.

The patch unit 200 has n*M input terminals and n*M output terminals, the n*M input terminals of the patch unit 200 are connected to the n*M output terminals of the pixel signal transmitting chip 100 in one-to-one correspondence, the n*M input terminals and the n*M output terminals of the patch unit 200 are connected in one-to-one correspondence through connection channels according to a predetermined rule, so that the pixel signals input in the first arrangement order are output in the second arrangement order. The predetermined rule refers to a rule for outputting the pixel signals input in the first arrangement in the second predetermined arrangement. As such, when the pixel signals are RGB pixel signals, the patch unit 200 has 3M input terminals and 3M output terminals.

The signal conversion chip 300 has n*M input terminals, the n*M input terminals of the signal conversion chip 300 are connected to the n*M output terminals of the patch unit in one-to-one correspondence. As such, when the pixel signals are RGB pixel signals, the signal conversion chip 300 has 3M input terminals.

Hereinafter, the above "predetermined rule" will be described by using a simple example shown in FIG. 1 and FIG. 2. In the embodiment shown in FIG. 1 and FIG. 2, the pixel signals are RGB pixel signals.

As shown in FIG. 1, in the case that the pixel signal transmitting chip 100 is directly connected to the signal conversion chip 300, an output terminal a1 of the pixel signal transmitting chip 100 outputting a pixel signal R1 is connected to an input terminal d1 of the signal conversion chip 300; an output terminal a2 of the pixel signal transmitting chip 100 outputting a pixel signal R2 is connected to an input terminal d2 of the signal conversion chip 300; an output terminal a3 of the pixel signal transmitting chip 100 outputting a pixel signal R3 is connected to an input terminal d3 of the signal conversion chip 300; an output terminal a4 of the pixel signal transmitting chip 100 outputting a pixel signal G1 is connected to an input terminal d4 of the signal conversion chip 300; an output terminal a5 of the pixel signal transmitting chip 100 outputting a pixel signal G2 is connected to an input terminal d5 of the signal conversion chip 300; an output terminal a6 of the pixel signal transmitting chip 100 outputting a pixel signal G3 is connected to an input terminal d6 of the signal conversion chip 300; an output terminal a7 of the pixel signal transmitting chip 100 outputting a pixel signal B1 is connected to an input terminal d7 of the signal conversion chip 300; an output terminal a8 of the pixel signal transmitting chip 100 outputting a pixel signal B2 is connected to an input terminal d8 of the signal conversion chip 300; and an output terminal a9 of the pixel signal transmitting chip 100 outputting a pixel signal B3 is connected to an input terminal d9 of the signal conversion chip 300.

Therefore, the first arrangement order of the RGB signals received by the signal conversion chip 300 is R1, R2, R3, G1, G2, G3, B1, B2, B3. The signal conversion chip 300 may convert the RGB pixel signals arranged in the first arrangement order into the display signal packet in the first predetermined format.

As shown in FIG. 2, in the case that the pixel signal transmitting chip 100 is connected to the signal conversion chip 300 through the patch unit 200, the output terminal a1 of the pixel signal transmitting chip 100 outputting a pixel signal R1 is connected to an input terminal b1 of the patch unit 200, the input terminal b1 of the patch unit 200 is connected to an output terminal c3 of the patch unit 200, and the output terminal c3 of the patch unit 200 is connected to the input terminal d3 of the signal conversion chip 300; the output terminal a2 of the pixel signal transmitting chip 100 outputting a pixel signal R2 is connected to an input terminal b2 of the patch unit 200, the input terminal b2 of the patch unit 200 is connected to an output terminal c1 of the patch unit 200, and the output terminal c1 of the patch unit 200 is connected to the input terminal d1 of the signal conversion chip 300; and the output terminal a3 of the pixel signal transmitting chip 100 outputting a pixel signal R3 is connected to an input terminal b3 of the patch unit 200, the input terminal b3 of the patch unit 200 is connected to an output terminal c2 of the patch unit 200, and the output terminal c2 of the patch unit 200 is connected to the input terminal d2 of the signal conversion chip 300.

The output terminal a4 of the pixel signal transmitting chip 100 outputting a pixel signal G1 is connected to an input terminal b4 of the patch unit 200, the input terminal b4 of the patch unit 200 is connected to an output terminal c6 of the patch unit 200, and the output terminal c6 of the patch unit 200 is connected to the input terminal d6 of the signal conversion chip 300; the output terminal a5 of the pixel signal transmitting chip 100 outputting a pixel signal G2 is connected to an input terminal b5 of the patch unit 200, the input terminal b5 of the patch unit 200 is connected to an output terminal c4 of the patch unit 200, and the output terminal c4 of the patch unit 200 is connected to the input terminal d4 of the signal conversion chip 300; and the output terminal a6 of the pixel signal transmitting chip 100 outputting a pixel signal G3 is connected to an input terminal b6 of the patch unit 200, the input terminal b6 of the patch unit 200 is connected to an output terminal c5 of the patch unit 200, and the output terminal c5 of the patch unit 200 is connected to the input terminal d5 of the signal conversion chip 300.

The output terminal a7 of the pixel signal transmitting chip 100 outputting a pixel signal B1 is connected to an input terminal b7 of the patch unit 200, the input terminal b7 of the patch unit 200 is connected to an output terminal c9 of the patch unit 200, and the output terminal c9 of the patch unit 200 is connected to the input terminal d9 of the signal conversion chip 300; the output terminal a8 of the pixel signal transmitting chip 100 outputting a pixel signal B2 is connected to an input terminal b8 of the patch unit 200, the input terminal b8 of the patch unit 200 is connected to an output terminal c7 of the patch unit 200, and the output terminal c7 of the patch unit 200 is connected to the input terminal d7 of the signal conversion chip 300; and the output terminal a9 of the pixel signal transmitting chip 100 outputting a pixel signal B3 is connected to an input terminal b9 of the patch unit 200, the input terminal b9 of the patch unit 200 is connected to an output terminal c8 of the patch unit 200, and the output terminal c8 of the patch unit 200 is connected to the input terminal d8 of the signal conversion chip 300.

Therefore, the second arrangement order of the RGB signals received by the signal conversion chip 300 is R2, R3, R1, G2, G3, G1, B2, B3, B1. The signal conversion chip 300 may convert the RGB signals arranged in the second arrangement order into the display signal packet in the second predetermined format.

In the embodiment shown in FIG. 2, the patch unit 200 is simple in structure and easy to realize.

Further preferably, the patch unit 200 may comprise a patch plate including two sets of pads, each set of pads include n*M pads, one set of pads function as input terminals of the patch plate, and the other set of pads function as output terminals of the patch plate, the one set of pads are communicated with the other set of pads in one-to-one correspondence according to the predetermined rule. Herein, the patch plate may be made from "a piece of PCB". The patch plate may also be an electronic device which has a simple structure and is easy to be manufactured. It should be noted that, on the patch plate, any pad is just communicated with another pad corresponding thereto and is not communicated with other pads. "Communicated with" herein refers to "electrically connected to".

Further preferably, as shown in FIG. 2, the patch unit 200 further comprises a resistor network detachably connected with the patch plate, the resistor network includes n*M resistors (dotted frames as shown in FIG. 2) which are connected between the n*M output terminals of the pixel signal transmitting chip 100 and the n*M input terminals of the signal conversion chip 300 in one-to-one correspondence, resistances of wires on the patch plate connected between the input terminals and corresponding output terminals of the patch plate are smaller than those of the resistors, and when the patch plate is detached, the pixel signal transmitting chip 200 is capable of outputting the pixel signals in the first arrangement order to the signal conversion chip 300 through the resistor network.

When the resistor network is connected to the patch plate, the wires between the input terminals and output terminals of the patch plate short-circuit the resistors of the resistor network, therefore, at this time, the resistor network does not work, and the pixel signals in the first arrangement order may still be converted into the pixel signals in the second arrangement order. Therefore, the signal conversion chip may output the display signal packet in the second predetermined format.

When the patch plate is detached, the output terminals of the pixel signal transmitting chip are connected to the input terminals of the signal conversion chip through the resistors of the resistor network, and the pixel signals input to the signal conversion chip are still in the first arrangement order, therefore, the signal conversion chip may output the display signal packet in the first predetermined format.

That is to say, in the case that the display panel to be driven is one with a size larger than the predetermined size, the resistor network may not be detached from the patch plate. In the case that the display panel to be driven is one with a size not larger than (原文为小于) the predetermined size, the resistor network may be detached from the patch plate. The signal conversion device provided in the present invention may be not only applied to a display panel with larger size, but also applied to a display with smaller size.

In the present invention, there is no limitation to the specific format of the display signal packet, and for example, as a specific embodiment, the display signal packet may be a low voltage differential signal (i.e. LVDS signal) packet.

Accordingly, n is 3, the pixel signals of various colors include red pixel signals, green pixel signals and blue pixel signals, the first predetermined format is a VESA format, the third predetermined format is a JEIDA format, M is 8 and N is 10.

Figure 3:
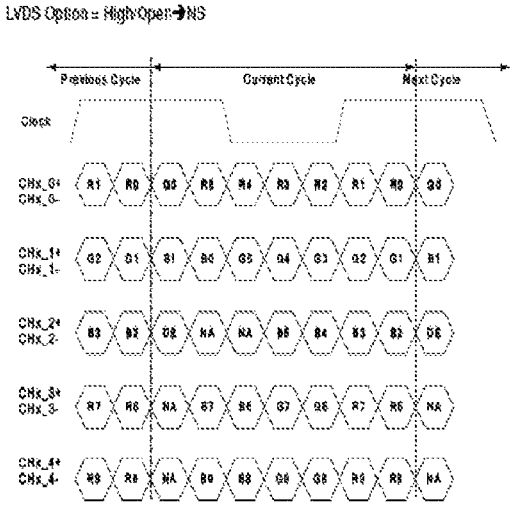
FIG. 3 is a diagram of a standard packet in a first predetermined format.
Figure 4:
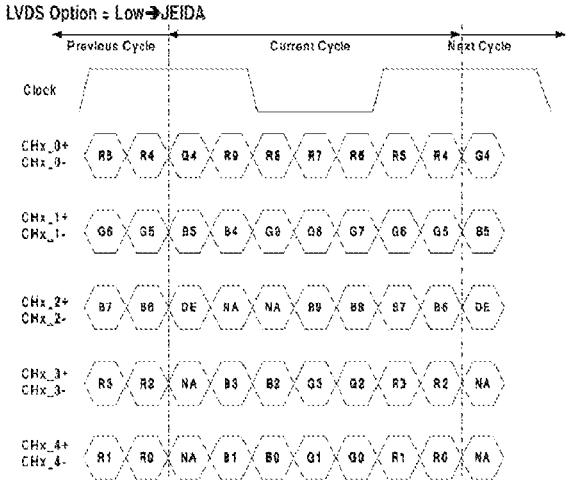
FIG. 4 is a diagram of a standard packet in a second predetermined format.

FIG. 3 shows arrangement of data in packet in the VESA format, and FIG. 4 shows arrangement of data in packet in the JEIDA format. It can be seen from FIG. 4, data of the lowest 2 bits corresponding to blue pixel signal B1 and B0, data of the lowest 2 bits corresponding to green pixel signal G1 and G0 and data of the lowest 2 bits corresponding to red pixel signal R1 and R0 are located in the last group of the packet in the JEIDA format.

Figure 5:
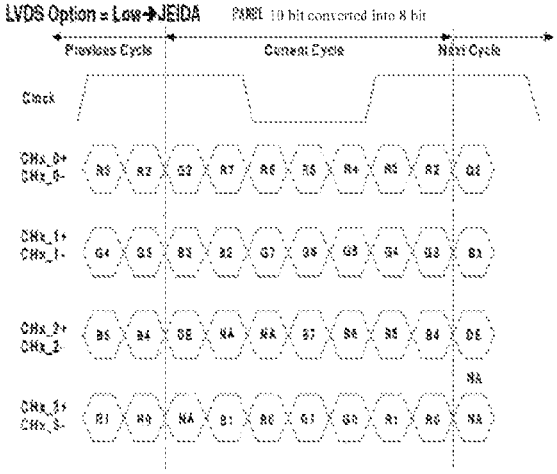
FIG. 5 is a diagram of a standard packet in a third predetermined format.
Figure 6:
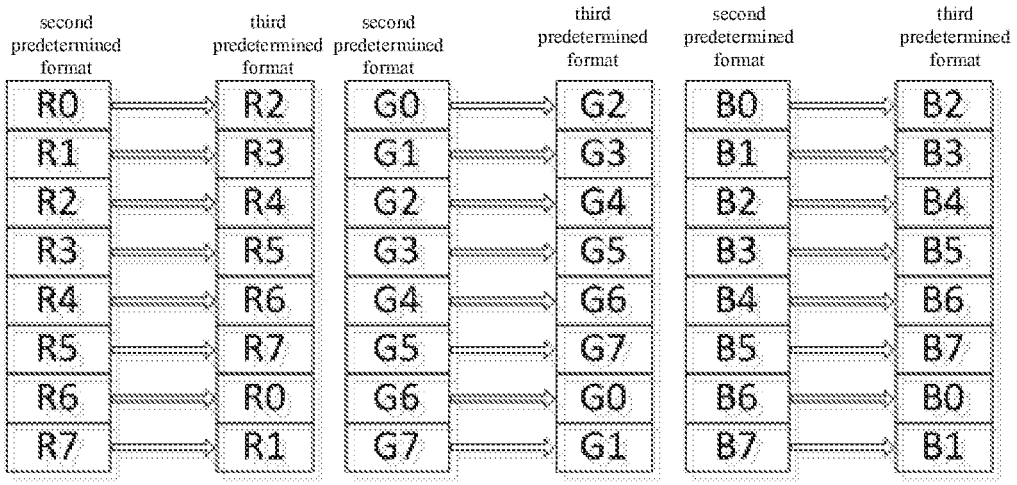
FIG. 6 is a diagram of a rule for signal conversion of a signal conversion device including a RGB888 chip and an EP387AP8F chip.

FIG. 5 is a diagram of a display signal packet in the third predetermined format. It can be seen from this drawing, the data is divided into four groups, and display data in the display signal packet in the second predetermined format correspond to display data in the display signal packet in the third predetermined format according to a relationship in FIG. 6. That is, the display data in the display signal packet in the second predetermined format is lower than the corresponding display data in the display signal packet in the third predetermined format by two bits.

A person skilled in the art should understand that, in FIG. 3 to FIG. 5, "Clock" represents "clock signal", "LVDS Option=High/Open→NS" refers to "at LVDS interface, level of mode selection PIN is High or Open, normal format (that is VESA format) is selected", "LVDS Option=Low→JEIDA" refers to "at LVDS interface, when level of mode selection PIN is low, JEIDA format is selected", "Previous Cycle" represents "the previous cycle", "Current cycle" represents "the current cycle", "Next Cycle" represents "the next cycle", "CHx_0+" represents "positive terminal of the 0th channel of LVDS interface", "CHx_0−" represent "negative terminal of the 0th channel of LVDS interface", "CHx_1+" represent "positive terminal of the 1st channel of LVDS interface", "CHx_1−" represents "negative terminal of the lth channel of LVDS interface", "CHx_2+" represents "positive terminal of the 2nd channel of LVDS interface", "CHx_2−" represents "negative terminal of the 2nd channel of LVDS interface", "CHx_3+" represents "positive terminal of the 3rd channel of LVDS interface", "CHx_3−" represents "negative terminal of the 3rd channel of LVDS interface", "CHx_4+" represents "positive terminal of the 4th channel of LVDS interface", "CHx_4−" represents "negative terminal of the 4th channel of LVDS interface", "DE" is an able signal (Data Enable), NA represents Null, that is, no signal is input.

As a specific embodiment of the present invention, the pixel signal transmitting chip 100 may be a RGB888 chip having 24 output terminals, the patch unit 200 has 24 output terminals and 24 input terminals, and the signal conversion chip 300 may be an EP387AP8F chip.

Figure 7:
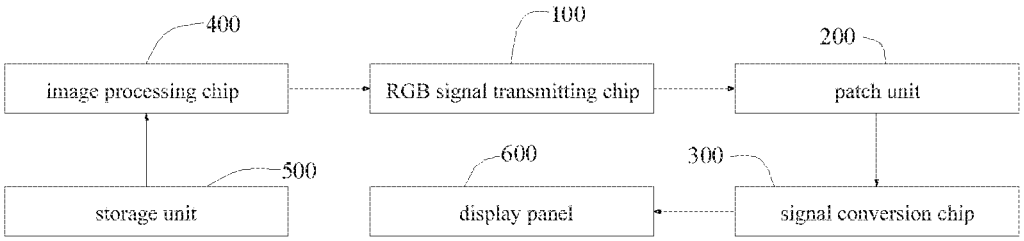
FIG. 7 is a structural diagram of a signal generating system provided in the present invention.

As another aspect of the present invention, a signal generating system shown in FIG. 7 is provided, the signal generating system comprises a image processing main chip 400 and a signal conversion device, the image processing main chip 400 is configured for converting a video or image into RGB pixel signals and transmitting the RGB pixel signals to a pixel signal transmitting chip 100 of the signal conversion device, wherein the signal conversion device is the signal conversion device provided above.

As shown in FIG. 7, the signal conversion device comprises the pixel signal transmitting chip 100, a patch unit 200 and a signal conversion chip 300.

As still another aspect of the present invention, a display apparatus is provided, still as shown in FIG. 7, the display apparatus comprises a display panel 600 and a signal generating system, wherein the signal generating system is the signal generating system provide above, the display panel 600 comprises a display signal input interface including N/2 channels, the M/2 output terminals of the signal conversion chip are respectively connected to the first M/2 channels of the display signal input interface in one-to-one correspondence.

The display signal packet in the second predetermined format is input into the display panel through the display signal input interface, for driving the display panel to display.

In the specific embodiment in which the first predetermined format is VESA format and the third predetermined format is JEIDA format, the predetermined size may be 42 inch.

The display apparatus may be a TV, a computer, an advertiser in a vehicle and the like.

Preferably, the display apparatus further comprises a storage unit 500 configured for prestoring a video or image, and output terminals of the storage unit 500 are connected to the input terminals of the image processing main chip 400.

Figure 8:
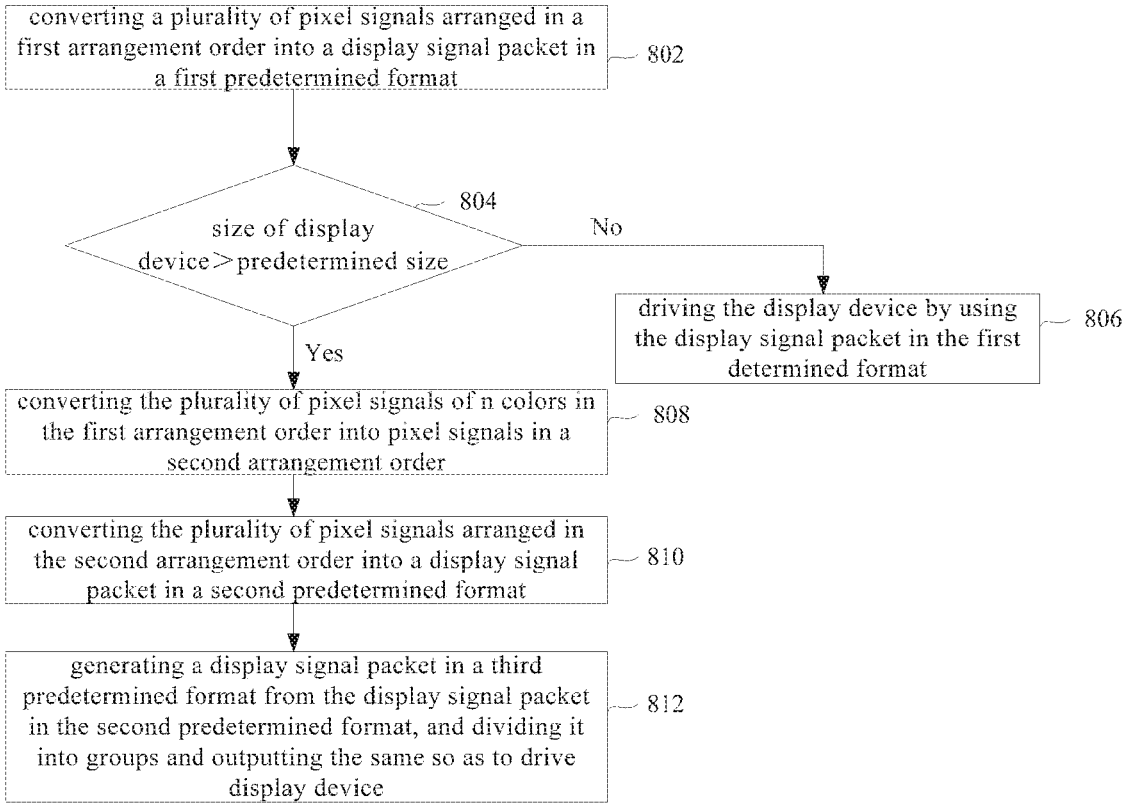
FIG. 8 is a flow chart illustrating a signal conversion method provided in the present invention.

As another specific embodiment of the present invention, a signal conversion method performed by the above signal conversion device provided in the present invention is provided, FIG. 8 is a flowchart illustrating the signal conversion method. As shown in FIG. 8, the signal conversion method comprises steps of:

Step S802, converting a plurality of pixel signals arranged in a first arrangement order into a display signal packet in a first predetermined format.

Step S804, judging whether size of a display device to be driven is larger than a predetermined size (for example, 42 inch) or not, if Yes, then performing step S808, and if No, then performing step S806.

Step S806, driving the display device by using the display signal packet in the first determined format.

Step S808, converting the plurality of pixel signals of n colors in the first arrangement order into pixel signals in a second arrangement order.

Step S810, converting the plurality of pixel signals arranged in the second arrangement order into a display signal packet in a second predetermined format.

Step S812, generating a display signal packet in a third predetermined format from the display signal packet in the second predetermined format, and dividing the generated display signal packet into groups and outputting the same so as to drive a display device.

In this embodiment, in the display signal packet in the first predetermined format and the display signal packet in the second predetermined format, display data corresponding to pixel signals of each color includes M bits, M is an even number, and in the display signal packet in the second predetermined format, a total n*M bits of display data are divided into M/2 groups;

A theoretical display signal packet for driving a predetermined display panel is in the third predetermined format, in the display signal packet in the third predetermined format, display data corresponding to pixel signals of each color includes N bits, N is an even number and larger than M, and in the display signal packet in the third predetermined format, a total n*N bits of display data are divided into N/2 groups, the lowest (N−M) bits of display data of each color are in the last (N−M)/2 groups, and are noise small analog signals, M/2 groups of display data in the display signal packet in the second predetermined format correspond to the first M/2 groups of display data in the display signal packet in the third predetermined format one to one, and any display data in the display signal packet in the second predetermined format is lower than a corresponding display data in the display signal packet in the third predetermined format by (N−M) bits.

As mentioned above, when the pixel signals are RGB pixel signals, n is 3, and when the pixel signals are RGBX pixel signals, n is 4.

As mentioned above, the display signal packet is a low voltage differential signal packet. Accordingly, n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

It should be understood that, the above embodiments are only exemplary embodiments used to explain the principle of the present invention and the protection scope of the present invention is not limited thereto. The person skilled in the art can make various variations and modifications without departing from the spirit and scope of the present invention, and these variations and modifications should be considered to belong to the protection scope of the invention.

The invention claimed is:

1. A signal conversion device, comprising a pixel signal transmitting chip configured for receiving and transmitting a plurality of pixel signals of n colors, which are arranged in a first arrangement order; and a signal conversion chip capable of converting the plurality of pixel signals arranged in the first arrangement order into a display signal packet in a first predetermined format and outputting the display signal packet to drive a display device with a predetermined size, wherein the signal conversion device further comprises:

a patch unit, which has input terminals connected to output terminals of the pixel signal transmitting chip, and is configured for rearranging the plurality of pixel signals in the first arrangement order into pixel signals in a second arrangement order and outputting the rearranged pixel signals;

a signal conversion chip capable of converting the plurality of pixel signals arranged in the second arrangement order into a display signal packet in a second predetermined format; and a signal generating and outputting unit configured for generating a display signal packet in a third predetermined format from the display signal packet in the second predetermined format output from the signal conversion chip, and dividing the generated display signal packet into groups and outputting the same so as to drive a display device with a size larger than the predetermined size, wherein in the display signal packet in the first predetermined format and the display signal packet in the second predetermined format, display data corresponding to pixel signals of each color includes M bits, M is an even number, and in the display signal packet in the second predetermined format, a total n*M bits of display data are divided into M/2 groups and the signal conversion chip outputs the M/2 groups of display data;

in the display signal packet in the third predetermined format, display data corresponding to pixel signals of each color includes N bits, N is an even number and larger than M, and in the display signal packet in the third predetermined format, a total n*N bits of display data are divided into N/2 groups, the lowest (N−M) bits of display data of each color are in the last (N−M)/2 groups, and are noise small analog signals;

the M/2 groups of display data in the display signal packet in the second predetermined format correspond to the first M/2 groups of display data in the display signal packet in the third predetermined format one to one, and any display data in the display signal packet in the second predetermined format is lower than a corresponding display data in the display signal packet in the third predetermined format by (N−M) bits.

2. The signal conversion device of claim 1, wherein the pixel signal transmitting chip has n*M output terminals, each of which is configured for outputting a pixel signal;

the patch unit has n*M input terminals and n*M output terminals, the n*M input terminals of the patch unit are connected to the n*M output terminals of the pixel signal transmitting chip in one-to-one correspondence, the n*M input terminals and the n*M output terminals of the patch unit are connected in one-to-one correspondence through connection channels according to a predetermined rule, so that the pixel signals input in the first arrangement order are output in the second arrangement order;

the signal conversion chip has n*M input terminals, the n*M input terminals of the signal conversion chip are connected to the n*M output terminals of the patch unit in one-to-one correspondence.

3. The signal conversion device of claim 2, wherein the patch unit comprises a patch plate including two sets of pads, each set of pads include n*M pads, one set of pads function as input terminals of the patch plate, and the other set of pads function as output terminals of the patch plate, and the one set of pads are communicated with the other set of pads in one-to-one correspondence according to the predetermined rule.

4. The signal conversion device of claim 3, wherein the patch unit further comprises a resistor network detachably connected with the patch plate, the resistor network includes n*M resistors which are connected between the n*M output terminals of the pixel signal transmitting chip and the n*M input terminals of the signal conversion chip in one-to-one correspondence, resistances of wires on the patch plate connected between the input terminals and corresponding output terminals of the patch plate are smaller than those of the resistors, and when the patch plate is detached, the pixel signal transmitting chip is capable of outputting the pixel signals in the first arrangement order to the signal conversion chip through the resistor network.

5. The signal conversion device of claim 4, wherein the display signal packet is a low voltage differential signal packet.

6. The signal conversion device of claim 5, wherein n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

7. The signal conversion device of claim 3, wherein the display signal packet is a low voltage differential signal packet.

8. The signal conversion device of claim 7, wherein n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

9. The signal conversion device of claim 2, wherein the display signal packet is a low voltage differential signal packet.

10. The signal conversion device of claim 9, wherein n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

11. The signal conversion device of claim 1, wherein the display signal packet is a low voltage differential signal packet.

12. The signal conversion device of claim 11, wherein n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

13. A signal generating system comprising a image processing main chip and a signal conversion device, the image processing main chip is configured for converting a video or image into pixel signals and transmitting the pixel signals to a pixel signal transmitting chip of the signal conversion device, wherein the signal conversion device is the signal conversion device of claim 1.

14. A display apparatus comprising a display panel and a signal generating system, wherein the signal generating system is the signal generating system of claim 13, the display panel comprises a display signal input interface including N/2 channels, and the M/2 output terminals of the signal conversion chip are respectively connected to the first M/2 channels of the display signal input interface in one-to-one correspondence.

15. The display apparatus of claim 14, further comprising a storage unit configured for prestoring a video or image, wherein output terminals of the storage unit are connected to the input terminals of the image processing main chip.

16. A signal conversion method comprising a step of converting a plurality of pixel signals arranged in a first arrangement order into a display signal packet in a first predetermined format to drive a display device with a predetermined size, wherein the signal conversion method further comprises steps of:

rearranging the plurality of pixel signals of n colors in the first arrangement order into pixel signals in a second arrangement order;

converting the plurality of pixel signals arranged in the second arrangement order into a display signal packet in a second predetermined format;

generating a display signal packet in a third predetermined format from the display signal packet in the second predetermined format, and dividing the generated display signal packet into groups and outputting the same so as to drive a display device with a size larger than the predetermined size, wherein in the display signal packet in the first predetermined format and the display signal packet in the second predetermined format, display data corresponding to pixel signals of each colors includes M bits, M is an even number, and in the display signal packet in the second predetermined format, a total n*M bits of display data are divided into M/2 groups;

in the display signal packet in the third predetermined format, display data corresponding to pixel signals of each color includes N bits, N is an even number and larger than M, and in the display signal packet in the third predetermined format, a total n*N bits of display data are divided into N/2 groups, the lowest (N−M) bits of display data of each color are in the last (N−M)/2 groups, and are noise small analog signals;

the M/2 groups of display data in the display signal packet in the second predetermined format correspond to the first M/2 groups of display data in the display signal packet in the third predetermined format one to one, and any display data in the display signal packet in the second predetermined format is lower than a corresponding display data in the display signal packet in the third predetermined format by (N−M) bits.

17. The signal conversion method of claim 16, wherein the display signal packet is a low voltage differential signal packet.

18. The signal conversion method of claim 17, wherein n is 3, the pixel signal transmitting chip is configured for receiving pixel signals of three colors of red, green and blue and transmitting the same, the first predetermined format is a VESA format, the third predetermined format is a JEIDA format, M is 8 and N is 10.

* * * * *